US009810459B2

(12) United States Patent
Ye

(10) Patent No.: US 9,810,459 B2
(45) Date of Patent: Nov. 7, 2017

(54) HEAT EXCHANGER AND AIR CONDITIONING SYSTEM HAVING AN ALLOCATION TUBE WITHIN HEAT EXCHANGER MANIFOLD

(71) Applicant: Hangzhou Sanhua Research Institute Co.,Ltd., Hangzhou, Zhejiang Province (CN)

(72) Inventor: Ke-Li Ye, Hangzhou (CN)

(73) Assignee: HANGZHOU SANHUA RESEARCH INSTITUTE CO., LTD., Hangzhou, Zhejiang Province (CN)

( * ) Notice: Subject to any disclaimer, the term of this patent is extended or adjusted under 35 U.S.C. 154(b) by 154 days.

(21) Appl. No.: 14/863,299

(22) Filed: Sep. 23, 2015

(65) Prior Publication Data

US 2016/0084581 A1 Mar. 24, 2016

(30) Foreign Application Priority Data

Sep. 23, 2014 (CN) ..... 2014 1 0490845

(51) Int. Cl.
*F25B 41/04* (2006.01)
*F25B 6/04* (2006.01)
(Continued)

(52) U.S. Cl.
CPC ..... *F25B 41/046* (2013.01); *F25B 6/04* (2013.01); *F28F 9/0273* (2013.01); *F25B 1/00* (2013.01); *F25B 5/04* (2013.01); *F25B 39/028* (2013.01); *F25B 39/04* (2013.01); *F25B 2341/0662* (2013.01); *F25B 2400/0409* (2013.01);
(Continued)

(58) Field of Classification Search
CPC ..... F25B 39/04; F25B 39/028; F25B 41/046; F25B 6/04; F25B 5/04; F25B 2400/0411; F25B 1/00; F28D 2021/0084; F28D 2021/0085; F28F 9/0246; F28F 9/0275; F28F 9/0231; F28F 2250/00; F28F 2250/06
See application file for complete search history.

(56) References Cited

U.S. PATENT DOCUMENTS 5,522,453 A * 6/1996 Green ..... B60S 1/487 165/154
2008/0093051 A1* 4/2008 Rios ..... F25B 41/067 165/61
(Continued)

*Primary Examiner* — David Teitelbaum
(74) *Attorney, Agent, or Firm* — Cheng-Ju Chiang

(57) ABSTRACT

A heat exchanger includes a first manifold, a second manifold, a plurality of flat tubes, and a plurality of fins. Two ends of the first manifold are respectively sealed with a cap. The heat exchanger further includes a first connecting pipe, a second connecting pipe, and a third connecting pipe. The first connecting pipe communicates with the first manifold via a second opening, the second connecting pipe communicates with an allocation tube, and the third connecting pipe communicates with the second manifold. A diameter of the first connecting pipe is greater than the diameter of the allocation tube. The two connecting pipes of the heat exchanger correspond to refrigerant in different states. The diameters of the two connecting pipes are different such that the refrigerant in different states may be uniformly allocated, which contributes to the efficiency of the heat exchanger.

18 Claims, 8 Drawing Sheets

(51) Int. Cl.

| | |
|---|---|
| *F25B 39/04* | (2006.01) |
| *F28F 9/02* | (2006.01) |
| *F25B 1/00* | (2006.01) |
| *F25B 39/02* | (2006.01) |
| *F28D 21/00* | (2006.01) |
| *F25B 5/04* | (2006.01) |

(52) U.S. Cl.
CPC ..... *F25B 2400/0411* (2013.01); *F28D 2021/0084* (2013.01); *F28D 2021/0085* (2013.01); *F28F 9/0231* (2013.01); *F28F 9/0246* (2013.01); *F28F 9/0275* (2013.01); *F28F 2250/00* (2013.01); *F28F 2250/06* (2013.01)

(56) References Cited

U.S. PATENT DOCUMENTS

| | | | | |
|---|---|---|---|---|
| 2009/0218084 | A1* | 9/2009 | Shinhama | F25B 39/04 165/175 |
| 2013/0192808 | A1* | 8/2013 | Liu | F25B 39/00 165/174 |
| 2013/0199764 | A1* | 8/2013 | Liu | F25B 39/028 165/181 |
| 2015/0168074 | A1* | 6/2015 | Bariar | F28D 7/106 165/154 |

* cited by examiner

HEAT EXCHANGER AND AIR CONDITIONING SYSTEM HAVING AN ALLOCATION TUBE WITHIN HEAT EXCHANGER MANIFOLD

BACKGROUND OF THE INVENTION

1. Field of the Invention

The present disclosure relates to air-condition technology, and more particularly to a heat exchanger and an air-condition system having the heat exchanger.

2. Discussion of the Related Art

With the development of low-carbon economy, strict demands regarding energy saving and emission reduction have been proposed. New energy vehicles have been newly developed in car industry. Electric automobiles or hybrid automobiles are characterized by energy conservation, and thus have been the current trend. However, batteries are key components for supplying power of the electric automobiles, and cost and the capacity/weight have somehow restricted the development of the new energy vehicles. It can be understood that the new energy vehicles also require newly design air-condition system for reducing the consumed energy, which may be, for instance, heat pump air-condition system.

With respect to the heat pump air-condition system, when the air-condition system needs to be cooled down, the heat exchanger within the vehicle operates as the evaporator, and the outdoor heat exchanger operates as the condenser. When the air-condition system needs to be heated up, the heat exchanger within the vehicle operates as the condenser, and the outdoor heat exchanger operates as the evaporator. However, as the outdoor heat exchanger operates respectively as the condenser and the evaporator, the physical states of refrigerant entering the heat exchanger may be different. One conventional solution may adopt complicated channel configuration to ensure the efficiency of the air-condition system and the heat exchanger. Another conventional solution may adopt two outdoor heat exchangers to respectively operate as the condenser and the evaporator. However, the cost of the above two solutions are relatively high. On the other hand, when the heat exchanger adopts micro-channels, the refrigerant may not be uniformly distributed.

Thus, how to uniformly distribute the refrigerant in the micro-channels of the heat exchanger when the heat exchanger operates under different modes is important

SUMMARY

In view of the above, the heat exchanger connects to the two connecting pipes via one manifold, wherein one connecting pipe connects to the manifold via the allocation tube, and the other connecting pipe connects to the manifold via the opening provided on the tube wall of the manifold. The two connecting pipes are prevented from being interfered by each other, such that appropriate diameters may be respectively configured for the two connecting pipes. In this way, the refrigerant in different states may be uniformly distributed when the heat exchanger operates under different modes, which contributes to the efficiency of the heat exchanger.

In one aspect, a heat exchanger includes: a first manifold, a second manifold, a plurality of flat tubes between the first manifold and the second manifold, and a plurality of fins arranged between each two adjacent flat tubes, the first manifold and the second manifold respectively comprising a plurality of connecting ports for communicating with the flat tubes, two ends of each of the flat tubes being inserted into the connecting ports of the first manifold and the connecting ports of the second manifold, each of the flat tubes communicating with the first manifold and the second manifold, the two ends of the first manifold being respectively sealed with a cap, the heat exchanger further comprising an allocation tube having a plurality of allocation holes in the first manifold, and the allocation tube communicating with the first manifold via the allocation holes; and wherein the allocation tube being inserted into the first manifold through the cap located at one end of the first manifold, a second opening being configured on a tube wall of the first manifold, the heat exchanger further comprising a first connecting pipe, a second connecting pipe, and a third connecting pipe, the first connecting pipe communicating with the first manifold via the second opening, the second connecting pipe communicating with the allocation tube, and the third connecting pipe communicating with the second manifold, and a flow area of a connecting point jointing between the first connecting pipe and the second opening is larger than a flow area of the allocation tube.

In another aspect, an air-condition system having a cooling mode and a heating mode includes: a compressor, an outdoor heat exchanger for performing heat exchange with outer environment, an air-condition assembly, and a first and a second throttling components, the air-condition assembly comprising a first heat exchanger, a second heat exchanger, and a first air door for controlling whether air pass through the first heat exchanger; a first electron magnetic valve, a second electron magnetic valve, and a third electron magnetic valve; the outdoor heat exchanger comprising a first manifold, a second manifold, a plurality of flat tubes between the first manifold and the second manifold, and a plurality of fins arranged between each two adjacent flat tubes, the first manifold and the second manifold respectively comprising a plurality of connecting ports for connecting the flat tubes, two ends of each of the flat tubes being inserted into the connecting ports of the first manifold and the second manifold, each of the flat tubes connecting with the first manifold and the second manifold, the two ends of the first manifold being respectively sealed with a cap, the first manifold further comprising an allocation tube having a plurality of allocation holes, the allocation tube connecting with the first manifold via the allocation holes; the allocation tube inserting into the first manifold via the cap located at one end of the first manifold, a second opening being configured on a tube wall of the first manifold, the heat exchanger further comprising a first connecting pipe, a second connecting pipe, and a third connecting pipe, wherein the first connecting pipe communicating with the first manifold via the second opening, the second connecting pipe communicating with the allocation tube, and the third connecting pipe communicating with the second manifold, an effective flow area of the first connecting pipe is larger than an effective flow area of the allocation tube, the second opening of the first manifold faces toward an external wall of the allocation tube, the second opening and an external wall of the allocation tube are spaced apart at a certain distance, and the second opening, the flat tubes, and the allocation tubes are prevented from being interfered by each other; an outlet of the compressor communicating with an inlet of the first heat exchanger, a first outlet pipeline and a second outlet pipeline are communicated with an outlet of the first heat exchanger, the first pipeline communicating with the first connecting pipe of the outdoor heat exchanger via the first electron magnetic valve, and the second pipeline communicating with the second connecting pipe of the outdoor heat exchanger via the first throttling component, two outlet pipelines are from outlet of the third connecting pipe of the outdoor heat exchanger, one outlet pipeline communicates with the inlet of the compressor via the second electron magnetic valve and a gas-liquid divider, the other outlet pipeline communicates with the inlet of the second heat exchanger via the third electron magnetic valve and the second throttling component; and an outlet of the second heat exchanger connecting to the inlet of the compressor via the gas-liquid divider.

In view of the above, the heat exchanger connects to the two connecting pipes via one manifold, wherein one connecting pipe connects to the manifold via the allocation tube, and the other connecting pipe connects to the manifold via the opening provided on the tube wall of the manifold. The two connecting pipes are prevented from being interfered by each other, such that appropriate diameters may be respectively configured for the two connecting pipes. In this way, the refrigerant in different states may be uniformly distributed when the heat exchanger operates under different modes, which contributes to the efficiency of the heat exchanger.

Figure 9:
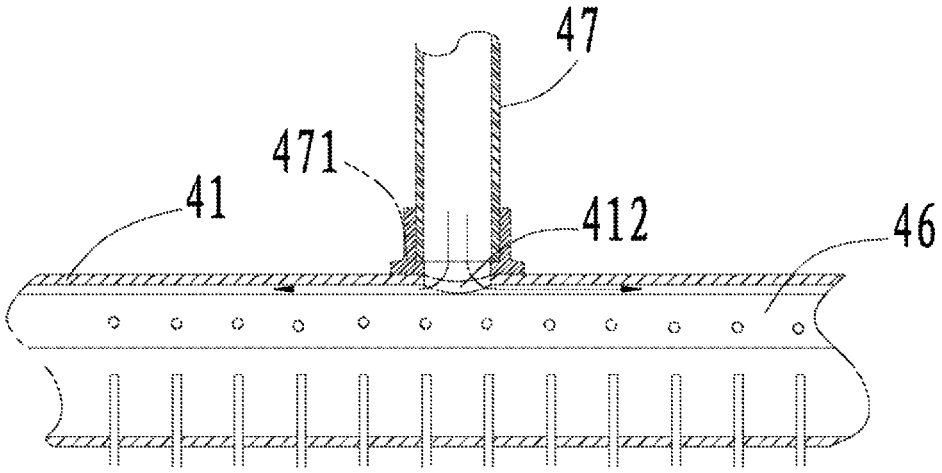
FIG. 9 is a partial enlarged view of FIG. 5.
Figure 10:
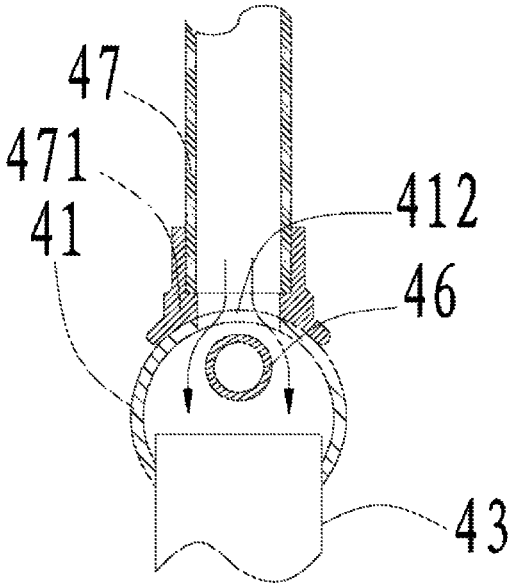
FIG. 10 is a partial enlarged view of FIG. 8.

The arrows in FIGS. 9 and 10 relate to directions of the flow within the heat exchanger.

DETAILED DESCRIPTION OF THE EMBODIMENTS

The present disclosure relates to a heat exchanger and an air-condition system including the heat exchanger. One end of the heat exchanger includes two connecting pipes, and the other end of the heat exchanger includes one connecting pipe. The two connecting pipes at the same end correspond to refrigerant in different states. The diameters of the two connecting pipes are different such that the refrigerant in different states may be uniformly allocated, which contributes to the efficiency of the heat exchanger.

Embodiments of the invention will now be described more fully hereinafter with reference to the accompanying drawings, in which embodiments of the invention are shown.

FIGS. 1-10 illustrate the heat exchanger in accordance with one embodiment. As shown, the heat exchanger includes a first manifold 41, a second manifold 42, a plurality of flat tubes 43 between the first manifold 41 and the second manifold 42, and a plurality of fins 44 arranged between each two adjacent flat tubes 43, and side plates 45 at lateral sides of the flat tubes. The first manifold 41 and the second manifold 42 respectively include a plurality of connecting ports for connecting the flat tubes. The two ends of each of the flat tubes 43 are inserted into the connecting ports of the first manifold 41 and the second manifold 42. Each of the flat tubes 43 communicates with the first manifold 41 and the second manifold 42.

Two ends of the first manifold 41 are respectively provided with a first cap 411 having a first opening 4111 and a fourth cap 414 sealing off the first manifold 41. The heat exchanger further includes an allocation tube 46 arranged within the first manifold 41. The allocation tube 46 includes a plurality of allocation holes 461 arranged in accordance with a certain density, and the diameters of the allocation holes 461 may be configured. Fluid may be uniformly flow into the first manifold 41 via the allocation holes 461. As such, the fluid may also be uniformly flow into each of the flat tubes 43 so as to enhance the heat exchanging efficiency of the heat exchanger. The structure of the fourth cap 414 is substantially similar to the first cap 411 for simplifying the manufacturing of the caps 411, 414. Furthermore, the fourth cap 414 may be configured to be a closed structure without the first opening. For example, the fourth cap 414 may include a recess opening towards the inner space of the first manifold 41, for limiting the location of the allocation tube 46.

The heat exchanger further includes a first connecting pipe 47, a second connecting pipe 48, and a third connecting pipe 49 connected with the pipes outside of the heat exchanger. The first connecting pipe 47 communicates with the first manifold 41, the second connecting pipe 48 communicates with the first manifold 41 via the allocation tube 46, and the third connecting pipe 49 communicates with the second manifold 42.

In addition, a second opening 412 may be configured on a tube wall of the first manifold 41. The first connecting pipe 47 communicates with the first manifold 41 via the second opening 412. To ensure the first connecting pipe 47 and the first manifold 41 are closely engaged, an adaptor 471 is provided between the first connecting pipe 47 and the first manifold 41. One end of the adaptor 471 may engage with an external wall of the first manifold 41 such that the adaptor 471 may surround the second opening 412 via welding, and may be closely fixed on the external wall of the first manifold 41. The other end of the adaptor 471 may be fixed with the first connecting pipe 47. Specifically, one end of the first connecting pipe 47 may insert into the adaptor 471, and then the first connecting pipe 47 may be fixed with the adaptor 471 via welding. It is to be noted that the second opening 412 may be configured in a location other than the location shown. That is, the second opening 412 may be configured on any locations of the first manifold 41 that is not relevant to the connecting ports of the flat tubes. The first connecting pipe may pass through the adaptor 471 so as to be partially located within the second opening 412, without being inserted to the inner space of the first manifold 41, for steadily positioning the first connecting pipe 47.

The second opening 412 within the first manifold 41 faces toward the allocation tube 46. In addition, the second opening 412 and the external wall of the allocation tube 46 are spaced apart at a certain distance H such that the fluid may be prevented from being blocked by the allocation tube 46 and thus may freely flow from the second opening 412 toward the first manifold 41. In addition, the fluid may be unequally flow into the first manifold 41 while flowing directly via the second opening 412. That is, the volume of the flow is larger with respect to the locations closer to the second opening 412 than that with respect to the locations farther than the second opening 412. In the embodiment, when the fluid pass through the first connecting pipe 47, the second opening 412, and then flow into the first manifold 41, the fluid first pass through the allocation tube 46. At this moment, the allocation tube 46 operates as damping devices. As being blocked by the allocation tube 46, the fluid flow along the axial and radial directions of the allocation tube 46. In this way, the fluid may be relatively equally distributed into each of the flat tubes 43 so as to enhance the efficiency of the heat exchanger.

In order to enhance the heat exchanging efficiency, in the embodiment, the second opening 412 is configured to be in a middle of the first manifold 41 at an axis extending direction of the first manifold. In addition, the second opening 412 is configured to be close to a top portion in the first manifold 41 at a lengthy extending direction of the flat tubes 43 perpendicular to the axis extending direction. In this way, when the fluid pass the second opening 412 and then flow into the first manifold 41, the fluid may be equally distributed so as to enhance the efficiency of the heat exchanger.

As shown, in the embodiment, the second connecting pipe 48 and the allocation tube 46 are integrally formed. In order to further illustrate the structure of the heat exchanger, the allocation tube within the heat exchanger is called as the allocation tube, and the second connecting pipe located outside of the heat exchanger is called as the second connecting pipe 48. It is to be noted that the above descriptions is not a limit to the second connecting pipe 48 and the allocation tube 46. The allocation tube 46 may insert toward inside of the first manifold 41 through the first opening 4111 of the first cap 411. In addition, two ends of the allocation tube 46 supports the first opening 4111. One end of the allocation tube 46 communicates with the second connecting pipe 48, and the other end of the allocation tube 46 is sealed by, for instance, welding. It is to be noted that one end of the allocation tube 46 may be sealed in the original design, or may be sealed by caps.

The fourth cap 414 arranged on one end of the first manifold 41 may wrap one end of the first manifold 41 by welding, and the first cap 411 arranged on the other end of the first manifold 41 may include the first opening 4111 and a first platform 4113 for assembling with second connecting pipe 48. In addition, the first opening 4111 protrudes from the first platform 4113. With such configuration, the contact dimension between the allocation tube 46 and the first opening 4111 has been increased, and thus the allocation tube 46 may be stably fixed on the first cap 411.

In order to maintain a distance H between the second opening 412 and the external wall of the allocation tube 46, in the embodiment, the distance H may be configured to be a minimum distance or an approximate minimum distance between the external wall of the allocation tube 46 and the second opening 412. In this way, the internal wall of the first opening 4111 is configured to be spaced apart from the internal wall of the first manifold 41 at a certain distance, such as H. The first opening 4111 is closer to an upper side of the first cap 411 such that there is a larger space in the bottom portion in the first manifold and between the allocation tube 46 and the first manifold 41. As such, the flat tube 43 may be easily and reasonably inserted into the first manifold 41, and the location and the diameter of the first opening 4111 may be adjusted, such that the location of the allocation pipe may be adjusted easily in accordance with real scenarios.

Figure 1:
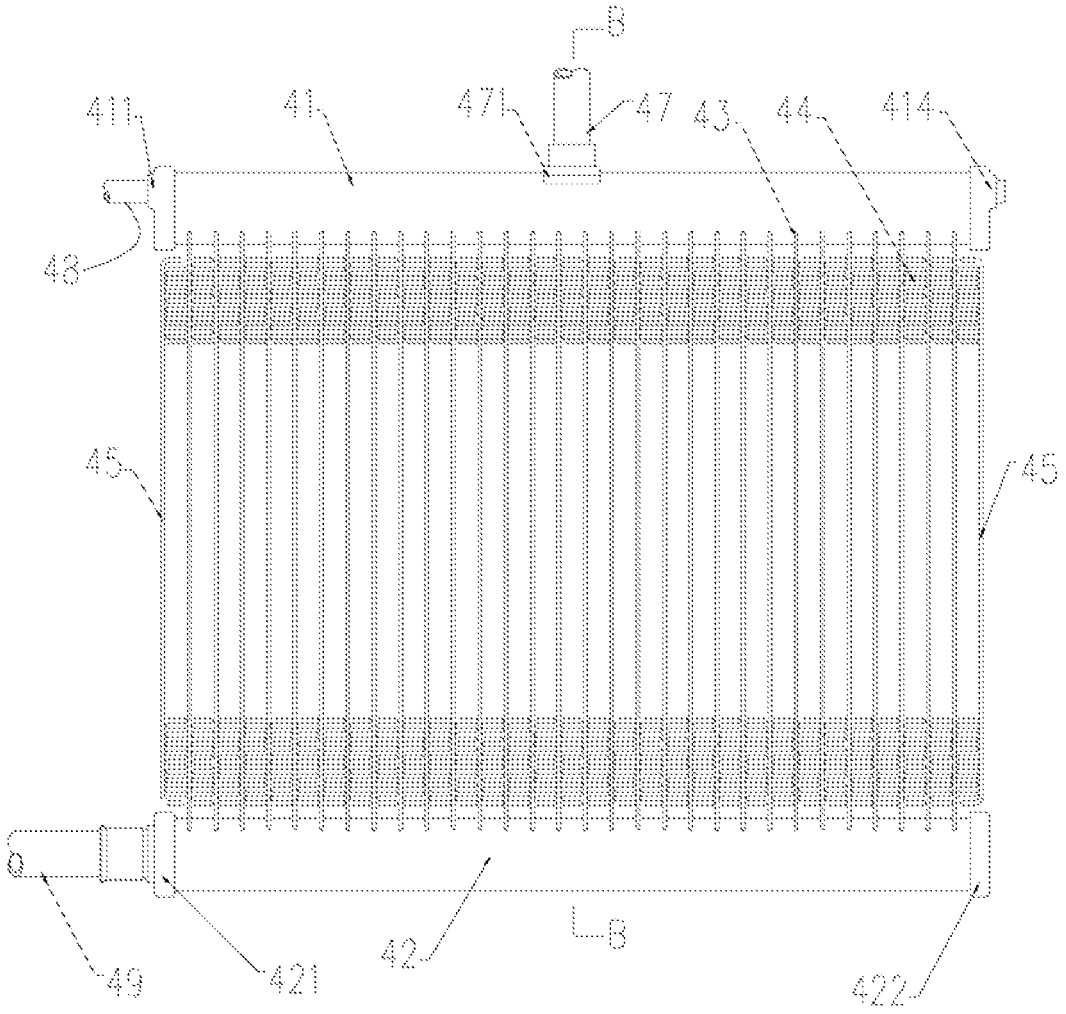
FIG. 1 is a schematic view of the heat exchanger in accordance with one embodiment.
Figure 2:
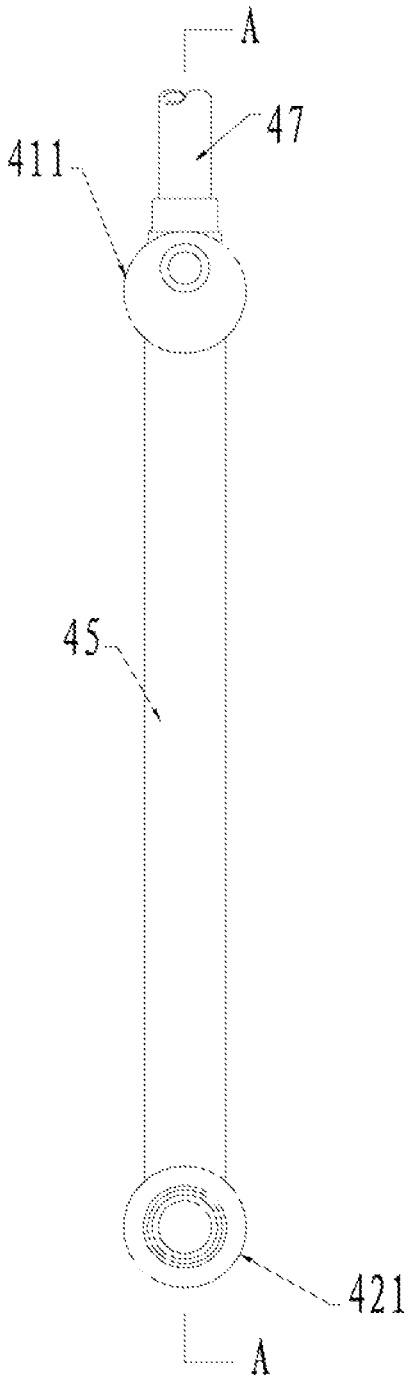
FIG. 2 is a side view of the heat exchanger of FIG. 1.
Figure 3:
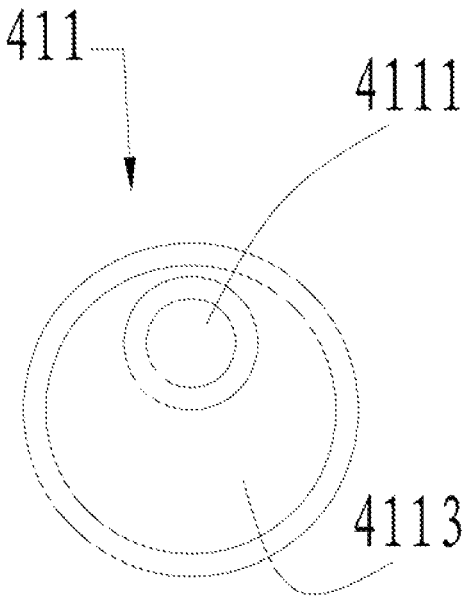
FIG. 3 is a schematic view of the first cap of the FIG. 2.
Figure 4:
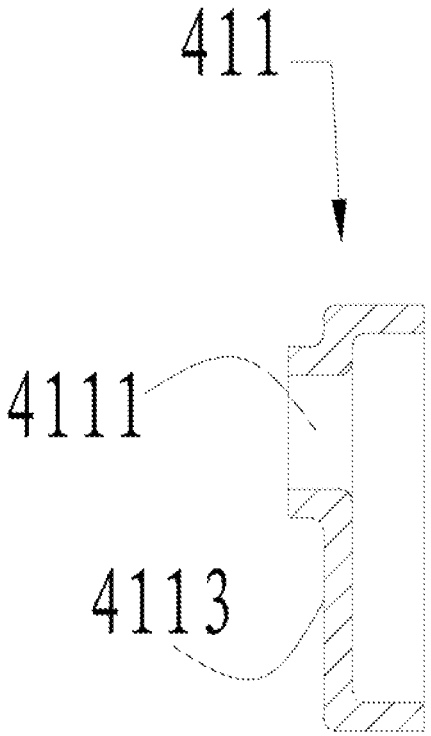
FIG. 4 is a cross-sectional view of the first cap of the FIG. 2.
Figure 5:
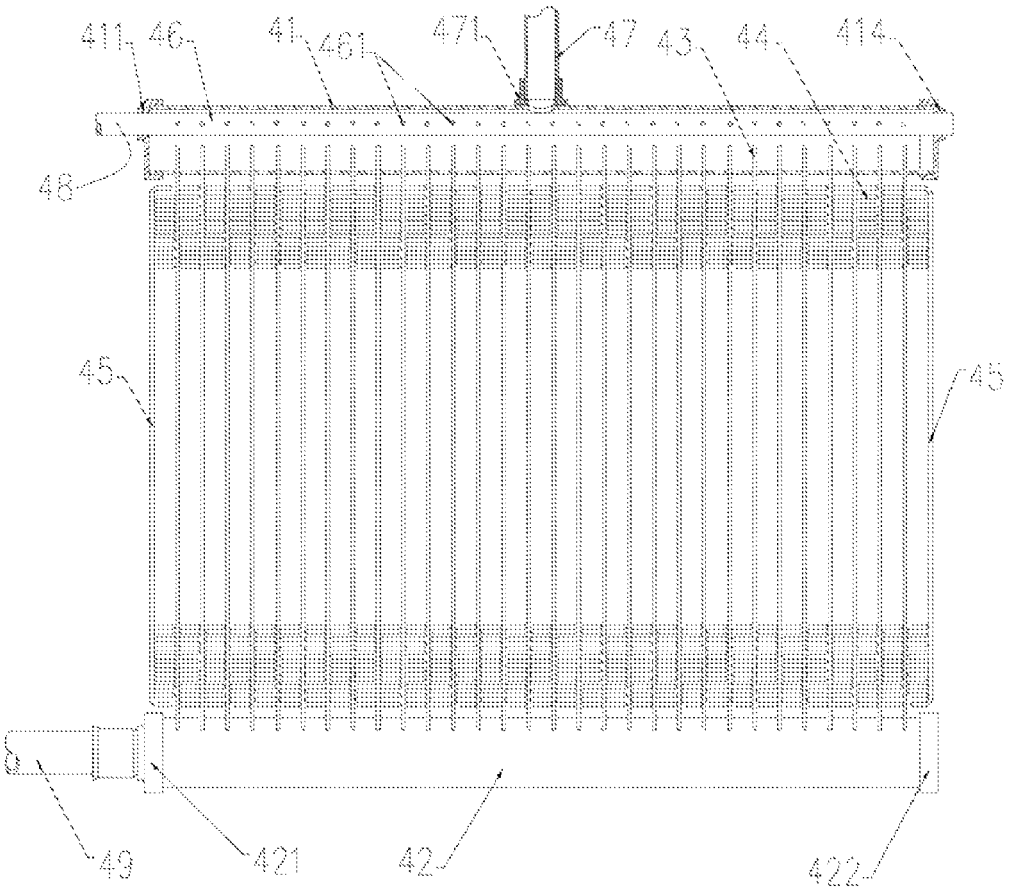
FIG. 5 is a cross-sectional view of the heat exchanger of FIG. 2 along the A-A line.
Figure 6:
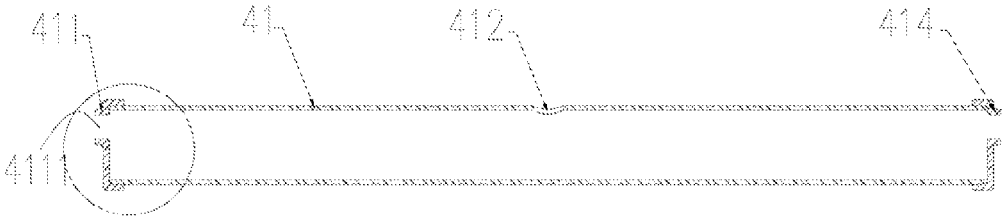
FIG. 6 is a cross-sectional view of the assembled first manifold and the first cap of FIG. 5.
Figure 7:
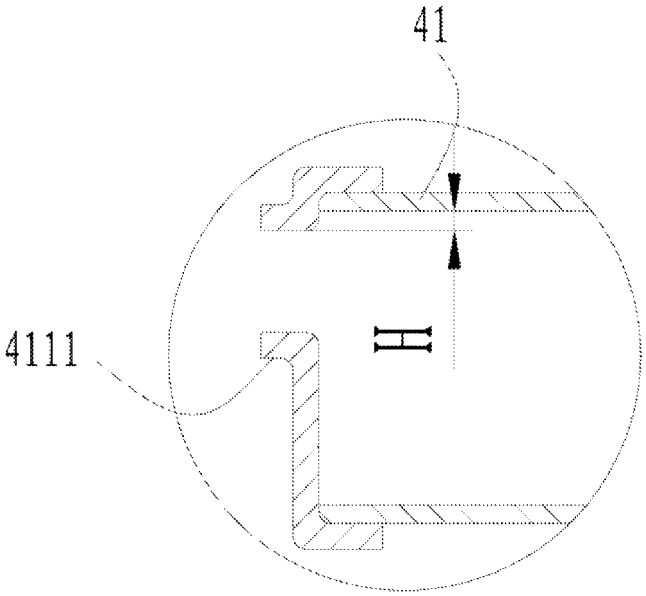
FIG. 7 is a partial enlarged view of FIG. 6.
Figure 8:
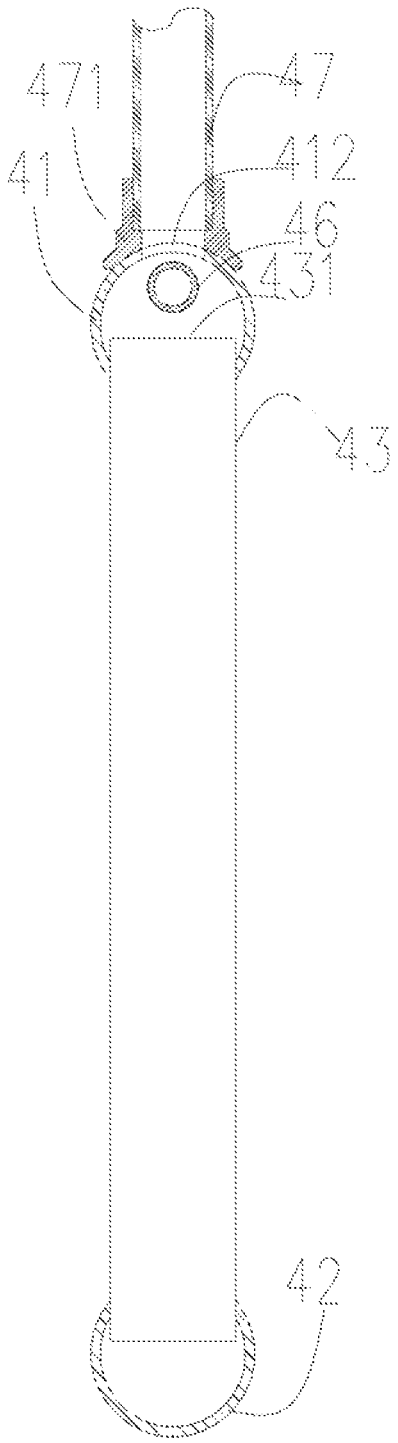
FIG. 8 is a cross-sectional view of the heat exchanger of FIG. 1 along the B-B line.

As shown in FIG. 8, at the length extending direction (i.e. a height direction) of the flat tube 43, the allocation tube 46 is located between the second opening 412 and an end portion of the flat tubes being inserted into the first manifold 41. A connecting line between a center of the second opening 412 and the center of the flat tube 43 passes through at least a portion of the tube wall of the allocation tube 46. The second opening 412 and an external wall of the allocation tube 46 are spaced apart at a certain distance, the first connecting pipe 47 is disposed on the external of the first manifold, and the end portion of the flat tubes 43 inserted into the first manifold 41 is spaced apart from the external wall of the allocation tube 46.

In the embodiment, the location of the first opening 4111 is not relevant to the location of the second opening 412. In addition, the first opening 4111 and the second opening 412 may be configured in accordance with real scenarios. In the embodiment, the diameter of the first opening 4111 may be smaller than that of the second opening 412 such that a flow diameter of the first connecting pipe 47 is larger than that of the second connecting pipe 48.

In this way, when the heat exchanger operates as the evaporator, the refrigerant enters the heat exchanger via the second connecting pipe 48. After entering the heat exchanger, the refrigerant may be refrigerant vapors at low temperature and at low pressure. That is, the refrigerant may be gas-liquid, and the density of the refrigerant is relatively high. Thus, the internal diameter of the second connecting pipe 48 has to be smaller.

When the heat exchanger operates as the condenser, the refrigerant enters the heat exchanger via the first connecting pipe 47. After entering the heat exchanger, the refrigerant may be refrigerant vapors at high temperate and at high pressure. That is, the refrigerant may be gas having smaller density. Thus, the internal diameter of the first connecting pipe 47 has to be larger than that of the second connecting pipe 48.

In addition, the internal diameter of the second connecting pipe 48 is smaller results in that the internal diameter of the first opening 4111 is also smaller. In this way, the flat tubes 43 may be easily installed within the first manifold 41, which avoids the interference between the flat tubes 43, the allocation tube and the second opening 412.

As shown, two ends of the second manifold 42 are respectively provided with a second cap 421 and a third cap 422. One end of the second cap 421 engages with one port of the second manifold 42, and the other end of the second cap 421 connects with the third connecting pipe 49. The third connecting pipe 49 communicates with the second manifold 42 via the second cap 421. The third cap 422 sleeves on the other port of the second manifold 42 so as to seal the port of the second manifold 42. It is to be noted that the third connecting pipe 49 may connect with the second manifold 42 via the adaptor. At this moment, the two ends of the second manifold 42 are sleeved by the caps, which means two ports of the second manifold 42 are sealed.

When the third connecting pipe operates as an outlet pipe of the heat exchanger operating as the condenser, the refrigerant flow out from the heat exchanger may be condensed liquid or the gas-liquid two-phase liquid, and the diameter of the exit pipe may be smaller. When the heat exchanger operates as the evaporator, the refrigerant flow out from the heat exchanger are gas at low temperature and at low pressure. At this moment, the diameter of the exit pipe has to be as large as possible so as to reduce the pressure loss of the refrigerant. The diameter of the third connecting pipe may be configured to be larger so as to be cooperatively operated under the above conditions. In order to enhance the heat exchanging efficiency of the heat exchanger, the diameter of the third connecting pipe is not smaller than that of the first connecting pipe.

Figure 11:
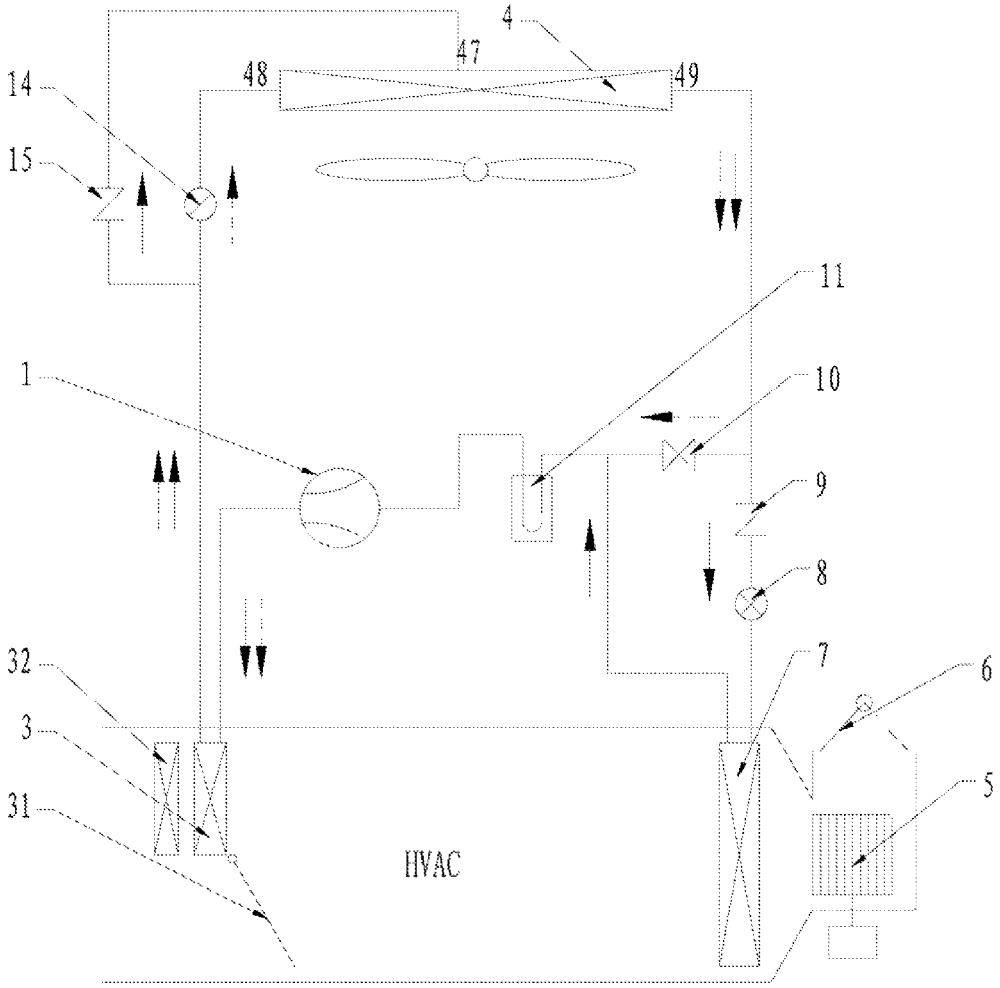
FIG. 11 is a schematic view of the heat exchanger in accordance with one embodiment.

FIG. 11 is a schematic view of the heat exchanger for a car air-condition system in accordance with one embodiment. The car air-condition system may operate under a cooling mode and a heating mode. The car air-condition system includes a compressor 1, an outdoor heat exchanger 4 for performing the heat exchange with outer environment, an air-condition assembly, and at least two throttling components including a first throttling component 14 and a second throttling component 8. The air-condition assembly for adjusting the temperature within the car includes a first heat exchanger 3, a second heat exchanger 7, an air blower 5, a first air door 31 for controlling whether the air may pass through the first heat exchanger 3, and a second air door 6. In order to enhance the heating capacity of the car air-condition system, the air-condition assembly may further include an auxiliary electric heater 32. The outdoor heat exchanger 4 may be the above heater.

The car air-condition further includes a first electron magnetic valve 15, a second electron magnetic valve 10, and a third electron magnetic valve 8. An outlet of the compressor 1 communicates with an inlet of the first heat exchanger 3 via channels. There are two channels originated from the exit of the first heat exchanger 3. The first pipeline communicates with the first connecting pipe 47 of the outdoor heat exchanger 4 via the first electron magnetic valve 15, and the second pipeline communicates with the second connecting pipe 48 of the outdoor heat exchanger 4 via a first throttling component 14. There are two channels originated from the third connecting pipe 49 of the outdoor heat exchanger 4. The first pipeline passes through the second electron magnetic valve 10 and a gas-liquid divider 11 so as to connect to the inlet of the compressor 1. The second pipeline passes through the third electron magnetic valve 9 and the second throttling component 8 so as to connect to the inlet of the second heat exchanger 7. The exit of the second heat exchanger 7 connects to the inlet of the compressor 1 via the gas-liquid divider 11.

When operating under the cooling mode, the first electron magnetic valve 15 and the third electron magnetic valve 9 are opened, the second electron magnetic valve 10 is closed, the second throttling component 8 is in working state, and the first air door 31 is switched such that the air is blocked from passing through the first heat exchanger 3. The compressor 1 consumes a certain amount of electric energy to compress the gaseous refrigerant at low temperature and at low pressure into gaseous refrigerant at high temperature and at high pressure. The working substance, such as refrigerant, comes out from the exit and arrives the first heat exchanger 3 via the channels. At this moment, the first air door 31 is closed such that the air flow and the first heat exchanger 3, basically, have not conducted heat exchange for the reason that the air flow is bypassed. After the refrigerant passes through the first heat exchanger 3, as the first electron magnetic valve 15 is opened, the refrigerant passes through the first electron magnetic valve 15 and the first connecting pipe 47 to enter the outdoor heat exchanger 4. The refrigerant at high temperature and at high pressure is cooled down within the outdoor heat exchanger 4 by the air outside, the refrigerant may be condensed and the heat may be released. The released heat is then taken out via the air flow. Afterward, the refrigerant flows out from the third connecting pipe 49 of the outdoor heat exchanger 4, and passes through the third electron magnetic valve 9 and the third electron magnetic valve 8 so as to enter the second heat exchanger 7. The refrigerant at low temperature and at low pressure absorbs the heat of the air flow within the second heat exchanger 7. After the temperature of the air flow is reduced and is blew into indoor, the indoor temperature is reduced. The phase of the refrigerant has been transitioned into gas, which is then separated by the gas-liquid divider 11. The liquid refrigerant are stored within the gas-liquid divider 11. The gaseous refrigerant at low temperature and at low pressure are then compressed into gaseous refrigerant at high temperature and at high pressure, and the above process is repeated.

When operating under the cooling mode, the outdoor heat exchanger 4 operates as the condenser. At this moment, the gaseous refrigerant enters the outdoor heat exchanger 4 via the first connecting pipe 47 with larger diameter. The first connecting pipe 47 directly communicates with the first manifold 41 via the second opening 412. That is, the refrigerant does not have to pass through the allocation holes of the allocation tube with smaller diameter and then enter the first manifold 41. In this way, the flowing resistance of the refrigerant has been greatly decreased to enhance the system efficiency. This avoids the increasing flowing resistance of the refrigerant caused by the sharply decreased dimension of the flow area, which may cause the energy loss of the refrigerant within flowing channel. When the gaseous refrigerant enters the first manifold 41 via the second opening 412, the fluid passes through the allocation tube 46 first. At this moment, the allocation tube 46 operates as the damping devices. The refrigerant fluid first flow along the axial and radial directions of the allocation tube 46. In this way, the refrigerant fluid may be equally distributed into each of the flat tubes 43 so as to enhance the efficiency of the outdoor heat exchanger 4.

When operating under the heating mode, the first electron magnetic valve 15 and the third electron magnetic valve 9 are closed, the first throttling component 14 is in working state, the second electron magnetic valve 10 is opened, and the first air door 31 is switched such that the air may pass through the first heat exchanger 3. The compressor 1 consumes a certain amount of electric energy to compress the gaseous refrigerant at low temperature and at low pressure into gaseous refrigerant at high temperature and at high pressure. The refrigerant comes out from the exit of the compressor 1 and arrives the first heat exchanger 3 via the channels. At this moment, the first air door 31 is opened such that the air flow and the first heat exchanger 3 exchange the heat. The air flow absorbs the heat of refrigerant at high temperature and then flows into indoor so as to increase the indoor temperature, the refrigerant may be condensed liquid or the gas-liquid two-phase. After passing through the first heat exchanger 3, as the first electron magnetic valve 15 is closed, the refrigerant passes through the first throttling component 14 and the temperature of the refrigerant is decreased. Afterward, the refrigerant passes through the second connecting pipe 48 and enters the outdoor heat exchanger 4. The refrigerant at low temperature and at low pressure within the outdoor heat exchanger 4 conduct the heat exchange with the outdoor air flow to absorb the heat of the outdoor air flow. The phase of the refrigerant has been transitioned into gaseous refrigerant. Afterward, the refrigerant comes out from the third connecting pipe 49 of the outdoor heat exchanger 4, passes through the second electron magnetic valve 10, separated by the 11, separated by the gas-liquid divider 11, and then the liquid refrigerant are stored within the gas-liquid divider 11. The gaseous refrigerant is then compressed into gaseous refrigerant at high temperature and at high pressure, and the above process is repeated.

When operating under the heating mode, the outdoor heat exchanger 4 operates as the evaporator. At this moment, the liquid or gaseous refrigerant enters the outdoor heat exchanger 4 via the second connecting pipe 48, and the second connecting pipe 48 communicates with the allocation tube 46. Afterward, the refrigerant enters the allocation holes 461 of the allocation tube 46 and then enters the first manifold 41. This can ensures the refrigerant may be uniformly distributed into the plurality of flat tubes 43. Thus, the heat exchange conducted by the outdoor heat exchanger 4 is uniform, which enhances the heat exchanging efficiency of the outdoor heat exchanger 4.

In view of the above, the outdoor heat exchanger 4 of the car air-condition system may operate as the condenser and also the evaporator. When the outdoor heat exchanger 4 operates as the evaporator, the refrigerant enters the heat exchanger via the second connecting pipe 48. The refrigerant entering the outdoor heat exchanger 4 may be both gas and liquid at low temperature and at low pressure. As the density of the refrigerant is relatively high, the diameter of the pipe has to be smaller. When the outdoor heat exchanger 4 operates as the condenser, the refrigerant enters the outdoor heat exchanger 4 via the first connecting pipe 47. The refrigerant entering the outdoor heat exchanger 4 may be the gaseous refrigerant at high temperature and at high pressure. The density of the refrigerant is smaller, and the diameter of the pipe has to be larger. When the outdoor heat exchanger 4 operates as the evaporator, the allocation tube has to be configured within the first manifold such that the refrigerant may be uniformly distributed within the first manifold. When the outdoor heat exchanger 4 operates as the condenser, the allocation tube may be omitted. In this way, the outdoor heat exchanger 4 may communicates with the first manifold 41 via the first connecting pipe 47 and the second connecting pipe 48 having different diameters. The second connecting pipe 48 communicates with the allocation tube 46 via the first manifold 41, and the locations of the first connecting pipe 47 is not relevant with that of the second connecting pipe 48. As such, the diameter of first connecting pipe 47 may be easily configured to be larger than that of the second connecting pipe 48. Further, the allocation tube 46 contributes to the distribution of the refrigerant when flowing from the first connecting pipe 47 into the first manifold 41. At this moment, the allocation tube 46 operates as the damping device, the fluid flow along the axial and radial directions of the allocation tube 46.

Furthermore, the first manifold 41 is arranged above the second manifold 42 within the outdoor heat exchanger 4. Within this configuration, the direction of the flow and the gravity with respect to the refrigerant is the same. As such, the lubricant mixed with the refrigerant may be flow back to the compressor smoothly, which ensures the efficiency of the compressor. At the same time, the flat tubes are configured to be vertically, and the fans are provided between the flat tubes. When the outdoor heat exchanger 4 operates as the evaporator under heating mode, condensed water on the fins may drop down from edges of the fins, which prevents the condensed water from being frozen quickly.

It is to be noted that the heat exchanger is not limited to the above disclosed car air-condition system. The heat exchanger may also be adopted in any air-condition system which has to be operated as a condenser and an evaporator.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A heat exchanger, comprising:

a first manifold, a second manifold, a plurality of flat tubes between the first manifold and the second manifold, and a plurality of fins arranged between each two adjacent flat tubes, the first manifold and the second manifold respectively comprising a plurality of connecting ports for communicating with the flat tubes, two ends of each of the flat tubes being inserted into the connecting ports of the first manifold and the connecting ports of the second manifold, each of the flat tubes communicating with the first manifold and the second manifold, the two ends of the first manifold being respectively sealed with a cap, the heat exchanger further comprising an allocation tube having a plurality of allocation holes in the first manifold, and the allocation tube communicating with the first manifold via the allocation holes; and wherein the allocation tube being inserted into the first manifold through the cap located at one end of the first manifold, a second opening being configured on a tube wall of the first manifold, the heat exchanger further comprising a first connecting pipe, a second connecting pipe, and a third connecting pipe, the first connecting pipe communicating with the first manifold via the second opening, the second connecting pipe communicating with the allocation tube, and the third connecting pipe communicating with the second manifold, and a first flow area of a connecting point jointing between the first connecting pipe and the second opening is larger than a second flow area of the allocation tube; and wherein the allocation tube is located between the second opening and an end portion of the flat tubes being inserted into the first manifold, a connecting line between a center of the second opening and a center of the flat tube passes through at least a portion of the tube wall of the allocation tube; and the second opening and an external wall of the allocation tube are spaced apart at a certain distance, the first connecting pipe is disposed on an external surface of the first manifold, and the second opening, the end portion of the flat tubes being inserted into the first manifold are spaced apart from the external wall of the allocation tube.

2. The heat exchanger as claimed in claim 1, wherein the second opening is configured to be at or close to a middle of the first manifold along an axis extending direction of the first manifold, and the second opening is configured to be on a top portion or close to the top portion in the first manifold at a lengthy extending direction of the flat tubes.

3. The heat exchanger as claimed in claim 2, wherein the cap being located at one end of the first manifold comprises a first opening and a first platform, the allocation tube inserts into the first manifold through the first opening, two ends of the allocation tube supports the first opening, one end of the two ends of the allocation tube communicates with the second connecting pipe, and the other end of the two ends of the allocation tube is sealed, and the allocation tube and the second connecting pipe are integrally formed.

4. The heat exchanger as claimed in claim 3, wherein the first opening protrudes from the first platform, the first opening is spaced apart from an edge of the first cap at a distance, and an internal wall of the first opening is configured to be spaced apart from the internal wall of the first manifold at a second certain distance.

5. The heat exchanger as claimed in claim 4, wherein an adaptor is provided between the first connecting pipe and the first manifold, one end of the adaptor engages with an external wall of the first manifold such that the adaptor surrounds the second opening and the adaptor is closely fixed on the external wall of the first manifold, and the other end of the adaptor is fixed with the first connecting pipe.

6. The heat exchanger as claimed in claim 5, wherein a diameter of the third connecting pipe is not less than a diameter of the first connecting pipe.

7. The heat exchanger as claimed in claim 6, wherein two ends of the second manifold are respectively provided with a second cap and a third cap, one end of the second cap engages with one port of the second manifold, and the other end of the second cap engages with the third connecting pipe, and the third cap engages with the other port of the second manifold so as to seal the other port of the second manifold.

8. The heat exchanger as claimed in claim 1, wherein the second opening is configured to be at or close to a middle of the first manifold along an axis extending direction of the first manifold, and the second opening is configured to be on a top portion or close to the top portion in the first manifold at a lengthy extending direction of the flat tubes.

9. The heat exchanger as claimed in claim 7, wherein a first cap being located at one end of the first manifold comprises a first opening and a first platform, the allocation tube inserts into the first manifold through the first opening, two ends of the allocation tube supports the first opening, one end of the allocation tube communicates with the second connecting pipe, and the other end of the allocation tube is sealed, and the allocation tube and the second connecting pipe are integrally formed; wherein the first opening protrudes from the first platform, the first opening is spaced apart from an edge of the first cap at a distance, and an internal wall of the first opening is configured to be spaced apart from the internal wall of the first manifold at a certain distance.

10. The heat exchanger as claimed in claim 1, wherein an adaptor is provided between the first connecting pipe and the first manifold, one end of the adaptor engages with an external wall of the first manifold such that the adaptor surrounds the second opening and the adaptor is closely fixed on the external wall of the first manifold, and the other end of the adaptor is fixed with the first connecting pipe; wherein a first diameter of the third connecting pipe is not less than a second diameter of the first connecting pipe.

11. An air-condition system having a cooling mode and a heating mode, comprising:

a compressor, an outdoor heat exchanger for performing heat exchange with an outer environment, an air-condition assembly, and a first and a second throttling components, the air-condition assembly comprising a first heat exchanger, a second heat exchanger, and a first air door for controlling whether air pass through the first heat exchanger;

a first electron magnetic valve, a second electron magnetic valve, and a third electron magnetic valve;

the outdoor heat exchanger comprising a first manifold, a second manifold, a plurality of flat tubes between the first manifold and the second manifold, and a plurality of fins arranged between each two adjacent flat tubes, the first manifold and the second manifold respectively comprising a plurality of connecting ports for connecting the plurality of flat tubes, two ends of each of the plurality of flat tubes being inserted into the connecting ports of the first manifold and the second manifold, each of the plurality of flat tubes connecting with the first manifold and the second manifold, the two ends of the first manifold being respectively sealed with a cap, the first manifold further comprising an allocation tube having a plurality of allocation holes, refrigerant fluidly connects from the allocation tube connecting with the first manifold via the allocation holes;

the allocation tube inserting into the first manifold via the cap located at one end of the first manifold, a second opening being configured on a tube wall of the first manifold, the outer heat exchanger further comprising a first connecting pipe, a second connecting pipe, and a third connecting pipe, wherein the first connecting pipe communicating with the first manifold via the second opening, the second connecting pipe communicating with the allocation tube, and the third connecting pipe communicating with the second manifold, an effective flow area of the first connecting pipe is larger than an effective flow area of the allocation tube, the second opening of the first manifold faces toward the external wall of the allocation tube, the second opening and an external wall of the allocation tube are spaced apart at a certain distance, and the second opening, the plurality of flat tubes, and the allocation tube are prevented from being interfered by each other;

an outlet of the compressor communicating with an inlet of the first heat exchanger, a first outlet pipeline and a second outlet pipeline are communicated with an outlet of the first heat exchanger, the first pipeline communicating with the first connecting pipe of the outdoor heat exchanger via the first electron magnetic valve, and the second pipeline communicating with the second connecting pipe of the outdoor heat exchanger via the first throttling component, two outlet pipelines are from outlet of the third connecting pipe of the outdoor heat exchanger, one outlet pipeline of the two outlet pipelines communicates with the inlet of the compressor via the second electron magnetic valve and a gas-liquid divider, an other outlet pipeline of the two outlet pipelines communicates with the inlet of the second heat exchanger via the third electron magnetic valve and the second throttling component; and an outlet of the second heat exchanger connecting to the inlet of the compressor via the gas-liquid divider.

12. The air-condition system as claimed in claim 11, wherein when operating under the cooling mode, the first electron magnetic valve and the third electron magnetic valve are opened, the second electron magnetic valve is closed, and the second throttling component is in a working state; gaseous refrigerant passes through the first connecting pipe and enters the outdoor heat exchanger, when entering the first manifold via the second opening, the gaseous refrigerant passes through the allocation tube and flows along axial and radial directions of the allocation tube; and when operating under the heating mode, the first electron magnetic valve and the third electron magnetic valve are closed, the second electron magnetic valve is opened, and the first throttling component is in the working state; liquid refrigerant or gas-liquid two-phase refrigerant passes through the second connecting pipe and enters the outdoor heat exchanger.

13. The air-condition system as claimed in claim 11, wherein the allocation tube of the outdoor heat exchanger is located between the second opening and an end portion of the flat tubes being inserted into the first manifold, a connecting line between a center of the second opening and a center of the flat tube passes through at least a portion of the tube wall of the allocation tube;

the first connecting pipe is disposed on an external surface of the first manifold, and the second opening, the end portion of the flat tubes being inserted into the first manifold are spaced apart from the external wall of the allocation tube.

14. The air-condition system as claimed in claim 11, wherein the second opening is configured to be at or close to a middle of the first manifold along the axis extending direction of the first manifold, and the second opening is configured to be on a top portion or close to the top portion in the first manifold at a lengthy extending direction of the flat tubes.

15. The air-condition system as claimed in claim 11, wherein the cap being located at one end of the first manifold comprises a first opening and a first platform, the allocation tube inserts into the first manifold through the first opening, two ends of the allocation tube supports the first opening, one end of the two ends of the allocation tube communicates with the second connecting pipe, and the other end of the two ends of the allocation tube is sealed, and the allocation tube and the second connecting pipe are integrally formed;

wherein the first opening protrudes from the first platform, the first opening is spaced apart from an edge of the first cap at a distance, and an internal wall of the first opening is configured to be spaced apart from the internal wall of the first manifold at a second certain distance.

16. The air-condition system as claimed in claim 11, wherein an adaptor is provided between the first connecting pipe and the first manifold, one end of the adaptor engages with an external wall of the first manifold such that the adaptor surrounds the second opening and the adaptor is closely fixed on the external wall of the first manifold, and an other end of the adaptor is fixed with the first connecting pipe.

17. The air-condition system as claimed in claim 11, wherein a diameter of the third connecting pipe is not less than a diameter of the first connecting pipe.

18. The air-condition system as claimed in claim 11, wherein the two ends of the second manifold are respectively provided with a second cap and a third cap, one end of the second cap engages with one port of the second manifold, and the other end of the second cap engages with the third connecting pipe, and the third cap engages with an other port of the second manifold so as to seal the other port of the second manifold.

* * * * *